United States Patent [19]

Swenson

[11] 4,128,360

[45] Dec. 5, 1978

[54] CUTTING TOOL BIT AND GRINDING FIXTURE FOR SHARPENING SAID BIT FOR USE IN AN AXIALLY ACTUATED BACK SPOT FACING TOOL

[76] Inventor: Henry F. Swenson, 22 Holmehill Ln., Roseland, N.J. 07068

[21] Appl. No.: 810,902

[22] Filed: Jun. 28, 1977

Related U.S. Application Data

[63] Continuation-in-part of Ser. No. 748,715, Dec. 8, 1976, abandoned.

[51] Int. Cl.[2] ..... B26D 1/00; B26D 1/12; B23B 51/16

[52] U.S. Cl. ..... 407/114; 407/45; 407/120; 408/187; 51/220

[58] Field of Search ..... 407/114, 113, 90, 82, 407/81, 120, 45; 408/187

[56] References Cited

U.S. PATENT DOCUMENTS

| | | | |
|---|---|---|---|
| 3,827,821 | 8/1974 | Swenson | 408/187 |
| 3,911,543 | 10/1975 | Sorice | 407/113 |

FOREIGN PATENT DOCUMENTS

| | | | |
|---|---|---|---|
| 650246 | 9/1937 | Fed. Rep. of Germany | 408/187 |

*Primary Examiner*—Leonidas Vlachos
*Attorney, Agent, or Firm*—Ralph R. Roberts

[57] ABSTRACT

This invention pertains to a cutting tool bit as used with and in the back spot facing tool as shown in my U.S. Pat. No. 3,827,821 as issued on Aug. 6, 1974. As shown in this patent the cutting tool bit member has unequal projections and cutting faces and it is contemplated that the shorter blade portion is three-quarters the length and has an effective cutting area three-quarters of the full length blade portion. To insure a smooth and flat spot face a precise grinding of this cutting tool bit is required. It is also required that the chips be directed in a desired spiral away from the cutting tool. An eight degree slope is provided as an angled face on the top surface of the cutting tool. The cutting edge of the cutting tool bit is also relieved preferably by a three degree slope away from the cutting edge. The top surface of the cutting tool also has a seven degree slope and with these combined three slopes it is desired and necessary that the facing cutting tool edge of the bit be ground at and with a 17 minute slope toward the center of the tool to insure that the faces of both the longer and the shorter cutting tool edges are in an exact plane and are exactly at 90° to the axis of the rotation of the tool. In one embodiment a chip breaker is formed in the top surfaces of the tool bit. Precise grinding fixtures are disclosed to grind the tool to this determined condition both with and without a chip breaker in the top surface of the bit.

8 Claims, 14 Drawing Figures

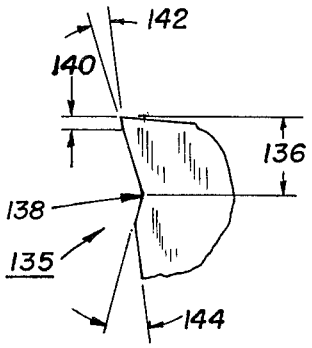
FIG. 10
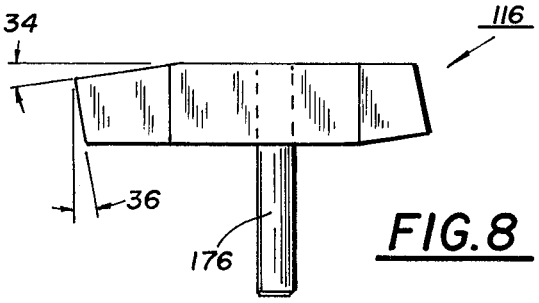
FIG. 8
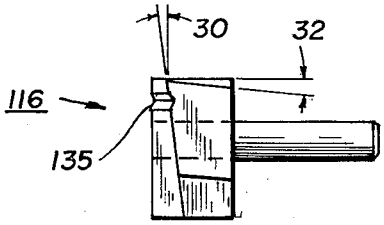
FIG. 9
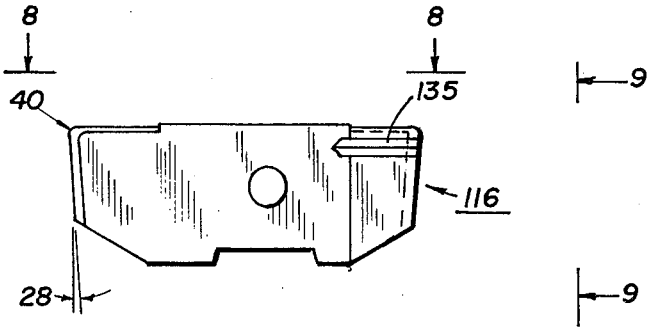
FIG. 7
FIG. 12
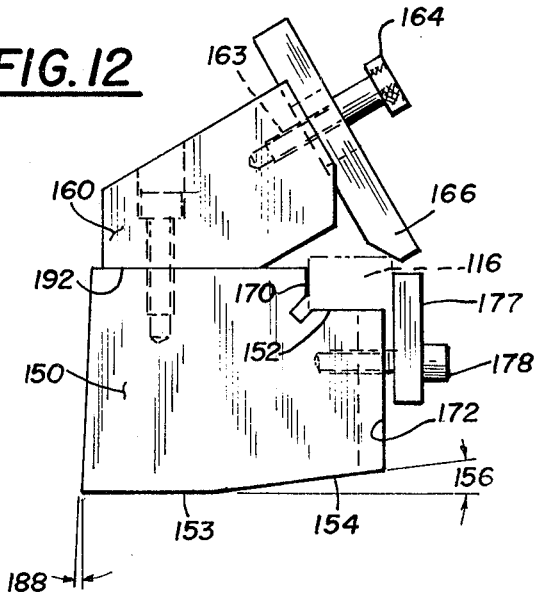
FIG. 11
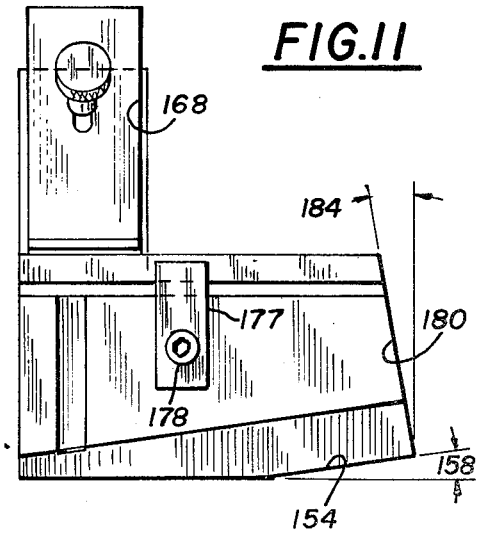

CUTTING TOOL BIT AND GRINDING FIXTURE FOR SHARPENING SAID BIT FOR USE IN AN AXIALLY ACTUATED BACK SPOT FACING TOOL

CROSS REFERENCE TO A RELATED INVENTION AND APPLICATION

This is a Continuation-in-Part Application of my Application entitled, "Cutting Tool Bit and Grinding Fixture for Sharpening Said Bit for Use in An Axially Actuated Back Spot Facing Tool" and filed Dec. 8, 1976 and assigned Ser. No. 748,715 and with the acceptance of this application, now abandoned.

This invention to the extent applicable is also closely related to U.S. Pat. No. 3,827,821 as issued on Aug. 6, 1974 and pertains to an actuated back spot facing tool which discloses the tool bit and a method of grinding the bit.

BACKGROUND OF THE INVENTION

1. Field of the Invention

With reference to the classification of art as established in the United States Patent Office this invention is found in the general Class entitled, "Metal Working" (Class 29) and in the subclass thereunder entitled, "Cutters" (subclass 95 R) and also to the class entitled, "Abrading" (Class 51) and to the subclass entitled, "Work Holders — Gauging Devices" (subclass 220).

2. Description of the Prior Art

Cutting tools and particularly back spot facing tools are well known and particularly that shown in the reference U.S. Pat. No. 3,827,821. In general a back spot facing tool is used in high production and in automatic positioning requiring either manual or hydraulic means for positioning and closing the cutting blade. In the above reference patent an unsymmetrical cutting tool is shown and, as reduced to practice, has proved highly satisfactory particularly with the shorter portions of the blade being about three-quarters of the full blade portion. Whereas the grinding fixture for the grinding of the cutting tool bit, as shown in the above-mentioned patent, anticipates grinding of the tool with only one clamping operation in the tool holder, the fixture as shown in the present apparatus anticipates the difficulty of grinding such a tool and the irregularities that arise in a one holder fixture. In the new cutting bit holder the cutting tool is precisely held for sharpening of only one cutting edge to a precise angle with compensation being made for the upper and forward rake formed on the cutting tool bit.

In an alternate bit and adjacent the cutting edge of each portion of this bit is formed a chip breaker. The holder is adapted for such a chip breaking groove to be ground in the bit and there is provision for a resharpening of the bit.

SUMMARY OF THE INVENTION

This invention may be summarized at least in part with reference to its objects.

It is an object of this invention to provide, and it does provide, a cutting blade for a back spot facing tool in which the cutting blade and its cutting edge is adapted to project a greater distance on one side of the tool than on the other side after axially actuated into a cutting position.

It is a further object of this invention to provide, and it does provide, a cutting blade which is pivotally retained in a cutting condition and when positively positioned by an adjustable stop the cutting face of the blades being at a precise right angle to the axis of the back spot facing tool.

It is also a further object of this invention to provide, and it does provide, a holder for the cutting tool bit so that the cutting tool bit may be sharpened and resharpened with a high degree of accuracy and precision and with ground support surfaces formed on the cutting tool holder for the developed slope of the tool.

It is also a further object of this invention to provide, and it does provide, a bit and holder so that a chip breaking groove may be ground in the top surface of each cutting edge portion. This holder enables the cutting tool bit to be sharpened and resharpened with a high degree of accuracy and precision with ground surfaces formed on the cutting tool holder and clamping means for the bit as the desired slope and form is ground in the tool cutting edges.

In the embodiment shown one cutting tool blade is representatively illustrated and has a three degree angle formed on the face of the cutting tool edge and a seven degree relief formed on the top of the cutting tool edge. To accommodate this slope of the blades the cutting tool holder has a seventeen minute slope formed as a part of the support surface so that the front cutting edges may be lightly dressed by a grinding wheel to bring the cutting edges to the precise angle necessary to provide full and three-quarter cuts in the same plane and with an accurate flatness.

In the cutting tool, to be hereinafter more fully described, hardened, high-speed steel is utilized and a precise seating and positioning shoulder is formed in this tool bit. This shoulder is made to accommodate the plug end of the back spot facing tool as described in the above-reference patent. Two projections of the bit for prescribed cutting areas are made in this tool bit. In one projection the bit extension is full size of the diameter to be machined and in the other projection three-quarters of a cut of the projection of the full diameter sweep of the bit is made. The through hole formed to receive the pivot pin of the back spot face tool resides in a central portion within the diameter of the spot face shank. The cutting tool grinding fixture instead of being a fixture requiring only one clamping of the tool bit, as shown in the reference patent, requires a withdrawal and a repositioning of the cutting tool to be employed with this fixture so that a precise grinding of the cutting tool edge may be achieved.

In an alternate embodiment there is shown a precisely ground bit with a chip breaker groove ground in each top surface of the cutting edges of the bit. An alternate tool bit grinding fixture is provided for holding the bit while grinding the bit with the chip breaker grooves and also for resharpening of the bit.

In addition to the above summary the following disclosure is detailed to insure adequacy and aid in understanding of the invention. This disclosure, however, is not intended to prejudice that purpose of a patent which is to cover each new inventive concept therein no matter how it may later be disguised by variations in form or additions of further improvements. For this reason there has been chosen a specific embodiment of the cutting tool bit as used in a back spot facing tool and also a specific embodiment of a grinding fixture by which the tool bit is held as it is sharpened and resharpened.

This specific embodiment of the cutting tool bit and the grinding fixture has been chosen for the purpose of illustration and description as shown in the drawings wherein:

BRIEF DESCRIPTION OF THE DRAWINGS

FIG. 7 represents a plan view of the cutting tool bit of FIG. 1 but with a chip breaker groove in the top surfaces of the cutting edges of the tool bit;

FIG. 8 represents a side view of the tool bit similar to the view of FIG. 2 but with a locating pin installed which aids in grinding the angles prescribed by the fixture;

FIG. 9 represents an end view of the tool bit with this view taken on the line 9—9 of FIG. 7 and looking in the direction of the arrows;

FIG. 10 represents an enlarged end view showing the chip breaking groove as ground in the top surface of the cutting edge portion of the bit;

FIG. 11 represents a side view of the tool bit grinding fixtures adapted for grinding the bit of FIGS. 7 through 10. This fixture is much like the fixture of FIG. 4 but adapted for grinding the bit of FIGS. 7 through 10 including the chip breaker;

FIG. 12 represents an end view of FIG. 11 and showing a cutting tool bit clamped in place and ready for grinding the cutting edges of the bit;

In the following description and in the claims various details are identified by specific names for convenience. The names, however, are intended to be generic in their application. Corresponding reference characters refer to like members throughout the several figures of the drawings.

The drawings accompanying, and forming part of, this specification disclose certain details of construction for the purpose of explanation of the broader aspects of the invention, but it should be understood that structural details may be modified in various respects without departure from the concept and principles of the invention and that the invention may be incorporated in other structural forms than shown.

DESCRIPTION OF THE CUTTING TOOL MEMBER OF FIGS. 1 THROUGH 3

Figure 2:
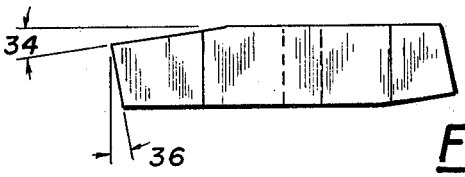
FIG. 2 represents a side view of the cutting tool bit of FIG. 1 as taken on the line 2—2 of FIG. 1 and looking in the direction of the arrows.
Figure 3:
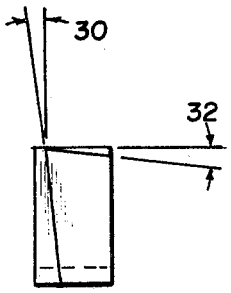
FIG. 3 represents a view of the cutting tool bit of FIG. 1, this view taken on the line 3—3 of FIG. 1 and looking in the direction of the arrows.
Figure 1:
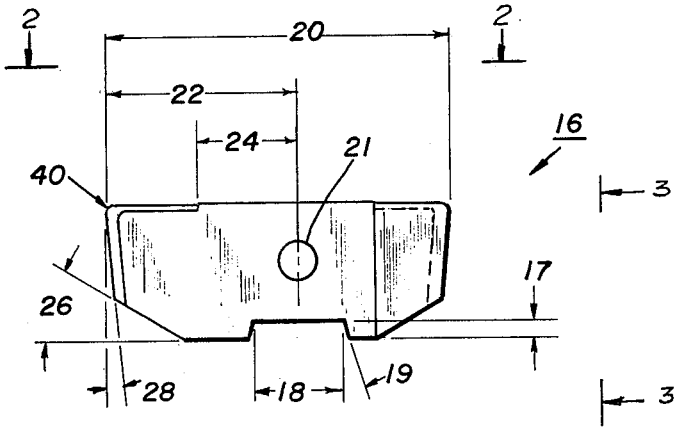
FIG. 1 represents a plan view of the cutting tool bit as used in the back spot facing apparatus, above-identified, this tool bit is precisely ground with unbalanced cutting edges so that a full sweep is provided by one cutting edge and a three-quarter sweep is provided by the other cutting edge.

Referring now in particular to FIGS. 1, 2 and 3, it is to be noted that a cutting tool bit is generally identified as 16 and has a piloting recess which is approximately one-eighth of an inch deep at dimension 17 and width 18. This recess accepts and accommodates the flat of the cam rod or plug as carried by the axially actuated back spot facing tool. A chamfer 19 is precisely made so that this cam rod of the axially actuated tool provides a determined seat and positioning for the cutting tool 16. A hole 21 is formed central of the dimension 18 so that the tool is precisely seated when and as it is pivoted around this hole 21.

A dimension 22 provides and establishes the maximum diameter of the spot face to be provided by this cutting tool bit. A radius 24 accommodates the embodied diameter of the back spot facing tool and beyond this diameter a cutting portion is established. A 30° angle corresponding to angle 26 is formed at the rear of the cutting portions of the back spot facing tool bit. This portion of the tool bit is removed to permit swinging of the cutting bit into position into a nonengaging or shielded position in the back spot facing tool. A relief of approximately 5° corresponding to dimension 28 is formed on both ends of the cutter so that only a sharp cutting edge is presented to the workpiece to be spot faced.

As seen in FIG. 3, the cutting edge of the bit is formed with a seven degree rake 30 at the top of the cutting edge portion and a three degree rake 32 is formed on the front of the bit. An included rearwardly directed angle of the cutting edge is 8° downwardly as indicated as 34. This angle establishes a desired deflecting cutting angle to the tool as it is rotated. A trailing relief of 10° indicated as 36 is also formed on the cutting tool bit. Angle 34 and 36 are also carried through on the smaller extending end portion of the cutting tool bit. This is three-quarters of the extension of dimension 22 minus dimension 24. The sharp corner is rounded approximately sixty-thousands of an inch radius and is indicated as dimension 40.

The tool bit, above-described, with particularity has been tested in field use and has proved to produce very satisfactory spot facing areas on workpieces when used with the tool holder as described in the above-referenced patent. The three-quarter extension of the short cutting edge has provided a very satisfactory cutting result. The relief angles, above indicated, provide the desired cutting and chip formation to result in a clean smooth back spot face. The grinding fixture, to be hereinafter more fully described, provides the desired grinding angles, above indicated. Note that in the fixture to be described the cutting tool bit must be removed from the fixture and turned end-for-end to be ground to the indicated angles and preciseness. It is to be noted that the same support surfaces of the fixture are used for each end and the angles on each end must be and are precisely alike.

Figure 6:
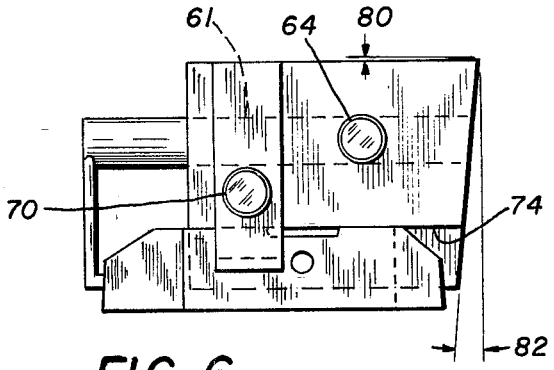
FIG. 6 represents a plan view looking downward on the grinding block fixture of FIG. 4 and showing in particular the relationship of the block and the grinding of the forward portion of the cutting tool bit.
Figure 5:
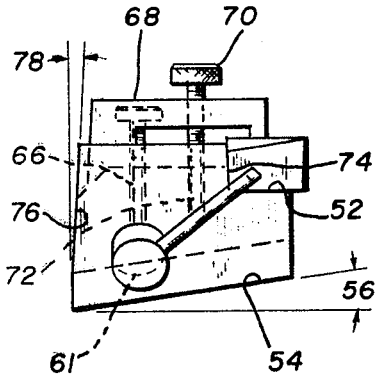
FIG. 5 represents an end view of the grinding fixture of FIG. 4 and showing a cutting tool bit clamped in place and ready for grinding of the top surface of the bit.
Figure 4:
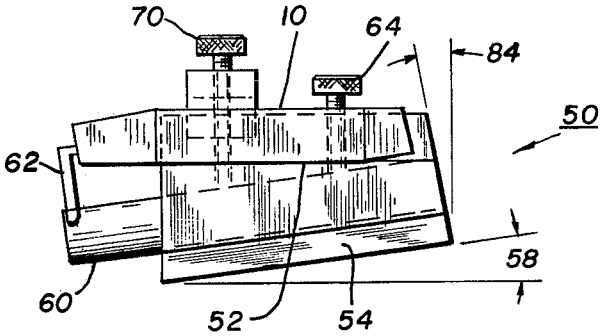
FIG. 4 represents a side view of the tool bit grinding fixture adapted for the cutting tool bit of FIG. 1 and showing in particular the relationship for grinding of the top angle of the cutting tool bit.

The Grinding Fixture of FIGS. 4, 5 and 6

Referring now to FIGS. 4, 5 and 6, there is depicted a grinding fixture or block 50 which is preferably of steel with a hardened ground outer case brought to a Rockwell "C" of 55 to 60 or greater. Steel is preferably used so that it may be held upon a magnetic surface plate for grinding by a tool cutter. As seen in FIG. 4, shelf 52 is a ground surface which is at a 7° angle to the bottom surface 54. This 7° angle is shown as dimension 56. This bottom surface 54 is also ground back to front at an 8° angle 58 to the shelf 52. For the purposes of positioning this cutter for the grinding of these two surfaces of a cutting tool bit 16 as held upon this shoulder surface 52 there is provided a rod 60 carried in a through hole 61. A finger portion 62 engages the end of the bit and is secured at this setting by tightening a thumb screw 64 carried in a threaded hole 66. The end of this screw engages the rod 60 and when tightened retains the finger portion 62 at the set position. Clamp member 68 is retained by a thumb screw 70 which is mounted in a threaded through hole 72. Clamp 68 retains the cutter member 10 on the shoulder 52 and also against an inner stop shoulder 74.

Back surface 76 is ground at a three degree angle identified as 78 to the surface 74 so that the front of the cutting tool bit is ground at a 3° angle. Back surface 76 in addition to being ground at the 3° angles is also ground at a 17 minute angle 80 to the surface 74 so that with the 8° downward angle and the 7° top relief the cutter edge is compensated by making the inner portion of the cutter a few thousandths of an inch in from a theoretical straight line parallel to the front of the bit 16. This developed cutting edge thus lies exactly in a straight plane. One end of the cutter is ground at the base, flank, along the face top relief and the front relief. The end of the bit is also formed with a 5° relief at angle 82 and a 10° angle 84 preliminarily formed on the cutter. The radius 40 provided on the end of the cutter is done by a grinding action separate from the grinding of the cutting edge in the holder 50.

The bit is removed from the fixture 50 after the one end has been sharpened to the desired angle and extent indicated. The bit 16 is then turned end-for-end and finger 62 is then repositioned and tightened in position. The clamp 68 is tightened to bring the bit 16 against the shoulders 52 and 74. The grinding block is placed on a magnetic chuck and the other end of the bit 16 is sharpened as above. Any small error or wear in the fixture 50 will be the same on both ground ends of the bit resulting in both ends of the bit producing the same angle when turned end-for-end as long as the same surfaces are used. The angles indicated for the bit have been found very satisfactory and are preferred in cutting steel. If aluminum is to be spot faced the angle on the cutting edge is made a sharper angle. A grinding fixture for this increased angle, of course, is then necessary.

ALTERNATE TOOL BIT AS IN FIGS. 7 THROUGH 10

Referring next to FIGS. 7 through 10 inclusive, there is depicted a tool bit 116 substantially like the bit 16 shown in FIGS. 1 through 3. This cutting tool bit has a chip breaking groove formed on each top surface of the cutting area. As with the bit 16, the dimensions 17, 18, 19, 21, 22, 24, 26, 28, 30, 32 and 34 are the same. As particularly seen in FIG. 10, there is formed in each 7° top surface a chip breaker groove 135. This groove is about one-eighth inch away from the cutting edge. The dimension is noted as 136 and is formed with a wheel having about a one-sixteenth inch radius. This is noted as 138. A land 140 of about twenty-thousandths of an inch is left in the 7° slope next to the cutting edge. Preferably a 10° angle 142 with the 7° sloped top surface leads from the land 140 to the radius axis 138. A 20° angle 144 leads from the radius axis 138 to the rear of the 7° sloped surface. The chip breaking grooves 135 are made fully coextensive as to length with each of the cutting edges of the tool bit 116.

GRINDING FIXTURE OF FIGS. 11 THROUGH 14

Referring next and finally to the tool bit grinding fixture of FIGS. 11 through 14 inclusive, there is depicted a fixture much like that shown in FIGS. 4 through 6. This fixture of FIGS. 11 through 14 is particularly adapted to the sharpening and resharpening of a tool bit 116 with a chip breaker groove 135. As depicted, a body block 150 is preferably of hardened steel. A shelf 152 if formed in the front top portion of this block. This is parallel to surface 153. A front angle surface 154 is formed at 7° to surface 153. This angle is designated as 156 and is seen in FIG. 12.

In FIG. 11 it is to be noted that the front angle surface 154 is also ground or formed at an 8° angle designated as 158. A top member 160 is secured to block 150 by a cap screw 162. Member 160 has a threaded hole 163 in which is mounted a knurled headed thumb screw 164. Screw 164 retains a clamp bar 166 in a groove 168 formed in top member 160. Clamp bar 166, when drawn into place by the screw 164, holds bit 116 to the shelf 152 and a back surface 170. Face 172 of the fixture 150 has a groove or slot 174 which provides a mounting stop for a pin 176 which is positioned and is a slide bit in this slot when grinding and resharpening the bit 16 or 116. The clamp bar 166 and screw 164 are removed when a chip breaking groove 135 is to be formed in the top surface of the cutting edge of the bit. A clamp bar 177 is moved into retaining engagement of the bit 116 by a socket head cap screw 178. This bar retains the bit in place on shelf 152 and back surface 170. The block 150 is positioned on angles surface 154 during the grinding of the chip breaking groove 136 into the bit by a shaped grinding wheel 179 shown in phantom outline in FIG. 14.

Figure 13:
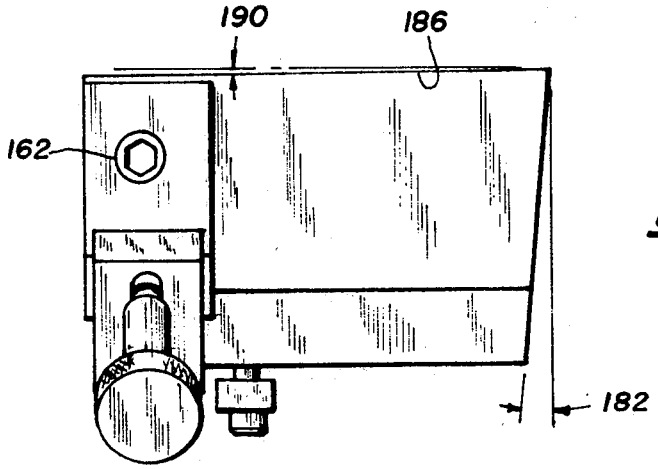
FIG. 13 represents a plan view looking downwardly on the fixture of FIG. 11.
Figure 14:
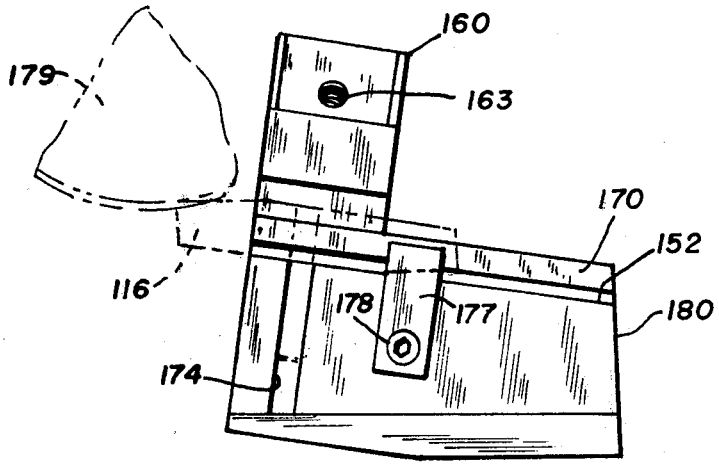
FIG. 14 represents the fixture of FIG. 11 with a tool bit of FIG. 8 mounted in place for grinding a chip breaking groove.

End 180 of the block 150 is ground at a compound angle so that the end of the bit may be ground with a single setting of the block. A 5° angle 182, as seen in FIG. 13, is also combined with a 10° angle 184, as seen in FIG. 11. Back surface 186 is ground at a 3° angle identified as 188 to the surface 153 so that the front of the cutting tool bit is ground at a 3° angle. Back surface 186, in addition to being ground at the 3° angle, is also ground at a 17 minute angle 190 to the face 172 so that with the eight degree downward angle and the seven degree top relief the cutter edge is compensated by making the inner portion of the cutter a few thousandths of an inch in from a theoretical straight line parallel to the front of the bit 16 or 116. This developed cutting edge thus lies exactly in a straight plane. One end of the cutter bit 16 or 116 is ground at the base, flank, along the face top relief and the front relief. There is also the end of the bit formed with a 5° relief at angle 182 and a 10° angle 184 preliminarily formed on the cutter. The radius 40 provided on the end of the cutter is done by a grinding action separate from the grinding of the cutting edge in the holder 50.

The bit is removed from the fixture 150 after the one end has been sharpened to the desired angle and extent indicated. The bit 116 is then turned end-for-end and clamp 166 is then tightened in position by knurled screw 164 to bring the bit 110 against the shelf 152 and back stop 170. The grinding block is placed on a magnetic chuck and the other end of the bit 16 is sharpened as above. Any small error or wear in the fixture 150 will be the same on both ground ends of the bit resulting in both ends of the bit producing the same angle when turned end-for-end as long as the same surfaces are used. The angles indicated for the bit with chip breaker have been found very satisfactory and are preferred in cutting steel. If aluminum is to be spot faced the angle on the cutting edge is made a sharper angle.

RESHARPENING OF BACK SPOT FACING TOOL

The bit of FIG. 1 or FIG. 7 may be easily resharpened using the fixture of FIG. 4 or FIG. 11. The bit is mounted in the fixture as for the original grinding or forming of the bit. To resharpen the bit it is necessary to grind the top and front surfaces. The compound angle surface 54 of FIG. 4 or 154 of FIG. 11 on the fixture depicted therein is placed on a magnetic chuck. Pin 176 is placed in slot 174 and assures a correct distance for both ends of the bit. The angled top and front surfaces are ground to remove a few thousandths of an inch from the top and front surfaces. A like amount is removed from the top and front surfaces of the other cutting end. Although block 150 may be made with portion 160 as an integral part, it is much more convenient to make as two separate portions with top surface 192 and front surface 172 used for reference in the forming of the various angled surfaces. Bottom 153 need not remain in the forming of sloped surface 154 but is a matter of selection of stock size. Surface 153 is not used with the forming of either end of the back spot facing tool. If the chip breaking groove 135 is to be deepened, the configuration of FIG. 10 is to be noted and followed. A grinding of this top surface will cause the chip breaking groove to become shallower. Resharpening and deepening of this groove may be achieved when desired.

Terms such as "left," "right," "up," "down," "bottom," "top," "front," "back," "in," "out" and the like are applicable to the embodiment shown and described in conjunction with the drawings. These terms are merely for the purpose of description and do not necessarily apply to the position in which the back spot facing tool and pivoted tool bit may be constructed or used.

While a particular embodiment of the tool bit and grinding block for this bit has been shown and described it is to be understood modifications may be made within the scope of the accompanying claims and protection is sought to the broadest extent the prior art allows.

What is claimed is:

1. A cutting tool bit for use in an axially actuated back spot facing tool, said tool bit of hardened material and having cutting edges along one side of the tool bit and diametrically oppositely disposed around a theoretical center and including: (a) a pivot hole of a precise diameter and establishing a theoretical center line of the tool bit, this pivot hole placed a selected distance from the rear edge of the tool bit; (b) a precise recess formed in one edge of the tool bit and on the side opposite the cutting edge, this recess sized to slidably engage an end of a cam rod mounted in and carried by the axially actuated back spot facing tool, the precise recess at a determined depth to establish the positioning of the tool bit on the entered end of the cam rod; (c) a guide chamfer formed at the entering end of this recess, said chamfer providing a guide path for the entrance and seating of the cam rod of the spot facing tool in said recess; (d) a cutting edge formed in one extension of the tool bit and as it is rotated with and by the tool this cutting edge generates a full sweep of the spot face, said cutting edge formed on that portion of the tool bit that extends beyond a supporting shank portion of the back spot facing tool, this cutting edge having a top relief, a front face relief, a backward slope and a compensation of these slopes with the front edge formed at a relief so that the cutting edge is at a true right angle to the theoretical axis of the tool bit, the cutting extension further having an end relief to the cutting edge and a chamfer formed on the cutter tool bit corners opposite the cutting edge, and (e) a cutting edge formed on the opposite tool bit extension, this extension having a length of about three-quarters the length of the effective cutting extension end, this shorter extension having a cutting edge of like front, top, backward slope, end and back corner chamfer and compensation for the front edge as is provided on the cutting edge formed on the full tool bit extension.

2. A cutting tool bit as in claim 1 in which the bit is made of high speed tool steel hardened to at least 60 Rockwell "C."

3. A cutting tool bit as in claim 2 in which the bit is ground for steel, cast steel, cast iron and the like and each cutting edge is ground with a 7° top relief, a 3° front relief, a downward slope of eight degrees, a compensation of 17 minutes and an end relief of about 5°.

4. A cutting tool bit as in claim 3 in which the outer cutting corner is radiused with about sixty-thousandths of an inch radius.

5. A cutting tool bit as in claim 3 in which the chamfer at the back corner of the cutting tool bit is about 30° and of about one-quarter of an inch extent.

6. A cutting tool bit as in claim 3 in which the recess is about one-eighth of an inch deep and the entering chamfer is about 15°.

7. A cutting tool bit as in claim 2 in which there is formed in each top relief surface a chip breaking groove which begins about one sixty-fourth of an inch from the cutting edge leaving a portion of the top relief surface adjacent the cutting edge.

8. A cutting tool bit as in claim 7 in which the chip breaking groove extends the full length of the top relief surface and the groove is formed by a contoured grinding wheel having a radius flowing into two angled slopes, the radius approximately one-sixteenth of an inch and at the axial alignment of the groove and contoured grinding wheel about one-eighth inch from the formed cutting edge.

* * * * *